US006379134B2

(12) United States Patent
Iizuka

(10) Patent No.: US 6,379,134 B2
(45) Date of Patent: Apr. 30, 2002

(54) SCROLL COMPRESSOR HAVING PAIRED FIXED AND MOVEABLE SCROLLS

(75) Inventor: Jiro Iizuka, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/849,253

(22) Filed: May 7, 2001

(30) Foreign Application Priority Data

May 16, 2000 (JP) ..... 2000-148654

(51) Int. Cl.[7] ..... F04C 18/04; F04C 23/00

(52) U.S. Cl. ..... 418/55.2; 418/55.3; 418/55.4; 418/60; 418/101; 418/151

(58) Field of Search ..... 418/55.2, 55.3, 418/55.4, 60, 101, 151

(56) References Cited

U.S. PATENT DOCUMENTS 3,802,809 A * 4/1974 Vulliez ..... 418/55.2
5,466,134 A * 11/1995 Shaffer et al. ..... 418/151
5,624,247 A * 4/1997 Nakamura ..... 418/60

FOREIGN PATENT DOCUMENTS

JP 5965586 4/1984
JP 5-141367 * 6/1993 ..... 418/55.2

* cited by examiner

*Primary Examiner*—John J. Vrablik
(74) *Attorney, Agent, or Firm*—Baker Botts L.L.P.

(57) ABSTRACT

A scroll compressor comprising paired fixed and movable scrolls, the fixed scroll of each pair having an end plate provided with a scroll body projecting from the end plate and the movable scroll of each pair having an end plate provided with a scroll body projecting from the end plate, wherein the movable scroll meshes with the fixed scroll to form a plurality of operation chambers between them and revolves relative to the fixed scroll to compress gas in the operation chambers is characterized in that two pairs of fixed and movable scrolls are disposed with back faces of the end plates of the fixed scrolls opposite each other, the movable scrolls are integrally connected with each other, a main shaft for revolving the movable scrolls passes through the two pairs of fixed and movable scrolls to operatively engage the movable scrolls, and an outlet chamber is disposed between the end plates of the fixed scrolls.

15 Claims, 3 Drawing Sheets

SCROLL COMPRESSOR HAVING PAIRED FIXED AND MOVEABLE SCROLLS

BACKGROUND OF THE INVENTION

The present invention relates to a scroll compressor.

Scroll compressors are known in the art. For example, Japanese Patent Laid-Open Publication No.59-65586 discloses a scroll compressor comprising paired fixed and movable scrolls, the fixed scroll of each pair having an end plate provided with a scroll body projecting from the end plate and the movable scroll of each pair having an end plate provided with a scroll body projecting from the end plate, wherein the movable scroll meshes with the fixed scroll to form a plurality of operation chambers between them and revolves relative to the fixed scroll to compress gas in the operation chambers, characterized in that two pairs of fixed and movable scrolls are disposed with back faces of the end plates of the fixed scrolls opposite each other, a main shaft for revolving the movable scrolls passes through the two pairs of fixed and movable scrolls to operatively engage the movable scrolls, and an outlet chamber is disposed between the end plates of the fixed scrolls.

In this known scroll compressor, the main shaft is supported at opposite ends by a housing accommodating the two pairs of fixed and movable scrolls. In the ordinary conventional scroll compressor comprising a pair of fixed and movable scrolls, and a main shaft operatively engaging the movable scroll at its one end, the main shaft is supported at its the other end by a housing accommodating the fixed scroll, the movable scroll and the main shaft. Therefore, the scroll compressor of Japanese Patent Laid-Open Publication No.59-65586 has advantages over the ordinary conventional scroll compressor, including that swirling of the main shaft is restrained, and vibration and noise due to such swirling of the main shaft are restrained.

However, the scroll compressor of Japanese Patent Laid-Open Publication No.59-65586 has following disadvantages.

1. Two movable scrolls are independent of each other. Therefore, anti-rotation mechanisms disposed between the end plates of the movable scrolls and the housing accommodating the scrolls are exposed to thrust load due to the compression of gas in the compression chambers, which causes them to wear and shorten the service life of the compressor. Downsizing of the compressor is difficult because downsizing of the ant-rotation mechanisms exposed to the thrust load is difficult 2. Also owing to the fact that two movable scrolls are independent of each other, adjustment of axial space between the fixed scroll and the movable scroll of one of the two pairs of fixed and movable scrolls must be carried out independently from the adjustment of axial space between the fixed and movable scrolls of the other of the two pairs of fixed and movable scrolls.

3. The main shaft operatively engages the movable scrolls at the central portions of the scroll bodies. Therefore, heat generated by bearings disposed at the operative engagement points is hard to disperse. As a result, the bearings are liable to heat and the service lives of the bearings are liable to become short.

4. No partition is disposed between bearings at the opposite ends of the main shaft and inlet chambers. Moreover, no partition is disposed between bearings at the operative engagement points and the inlet chambers. Therefore, gas taken into the inlet chambers is contaminated with lubricating oil in the bearings and the discharged gas is contaminated with lubricating oil. Therefore, the scroll compressor is not suitable for the compression of clean gas.

5. Also owing to the fact that no partition is disposed between bearings at the opposite ends of the main shaft and inlet chambers and no partition is disposed between bearings at the operative engagement points and the inlet chambers, gas heated by the hot bearings and increased in specific volume is taken into the operation chambers. As a result, flow rate of discharged gas from the scroll compressor is really low.

6. The bearings at the opposite ends of the main shaft and the bearings at the operative engagement points are disposed in substantially closed spaces. Therefore, heat generated by the bearings is hard to disperse, the bearings are liable to heat, and service lives of the bearings are liable to become short.

SUMMARY OF THE INVENTION

Therefore, the object of the present invention is to overcome the foregoing problems by providing a scroll compressor comprising paired fixed and movable scrolls, the fixed scroll of each pair having an end plate provided with a scroll body projecting from the end plate and the movable scroll of each pair having an end plate provided with a scroll body projecting from the end plate, wherein the movable scroll meshes with the fixed scroll to form a plurality of operation chambers between them and revolves relative to the fixed scroll to compress gas in the operation chambers, characterized in that two pairs of fixed and movable scrolls are disposed with back faces of the end plates of the fixed scrolls opposite each other, a main shaft for revolving the movable scrolls passes through the two pairs of fixed and movable scrolls to operatively engage the movable scrolls, and an outlet chamber is disposed between the end plates of the fixed scrolls.

In accordance with the present invention, there is provided a scroll compressor comprising paired fixed and movable scrolls, the fixed scroll of each pair having an end plate provided with a scroll body projecting from the end plate and the movable scroll of each pair having an end plate provided with a scroll body projecting from the end plate, wherein the movable scroll meshes with the fixed scroll to form a plurality of operation chambers between them and revolves relative to the fixed scroll to compress gas in the operation chambers, characterized in that two pairs of fixed and movable scrolls are disposed with back faces of the end plates of the fixed scrolls opposite each other, the movable scrolls are integrally connected with each other, a main shaft for revolving the movable scrolls passes through the two pairs of fixed and movable scrolls to operatively engage the movable scrolls, and an outlet chamber is disposed between the end plates of the fixed scrolls.

In the present scroll compressor, the two movable scrolls integrally connected with each other bear the thrust load accompanying the compression of gas in the operation chambers. Therefore, anti-rotation mechanisms disposed between the end plates of the movable scrolls and a housing accommodating the scrolls and the main shaft do not bear the thrust load. As a result, wear of the anti-rotation mechanisms is minimized and the shortening of the service life of the compressor is minimized. Being free from the thrust load, the anti-rotation mechanisms can be downsized. As a result, the compressor can be downsized.

In the present scroll compressor, the two movable scrolls are integrally connected with each other. Therefore, axial spaces between the fixed scrolls and the movable scrolls of the two pairs of fixed and movable scrolls can be adjusted by a single operation.

According to a preferred embodiment of the present invention, the main shaft operatively engages the movable scrolls at the back faces of the end plates of the movable scrolls.

When the main shaft operatively engages the movable scrolls at the back faces of the end plates of the movable scrolls, the operative engagement points are close to the housing accommodating the two pairs of fixed and movable scrolls. Therefore, heat generated by the bearings at the operative engagement points is able to disperse to outside the compressor. As a result, heating of the bearings at the operative engagement points is suppressed and shortening of the service lives of the bearings is minimized.

According to another preferred embodiment of the present invention, the movable scrolls abut against a housing accommodating the two pairs of fixed and movable scrolls through seal members at peripheral portions of the back faces of the end plates.

Anti-rotation mechanisms and bearings of the main shaft are disposed between the back faces of the end plates of the movable scrolls and the portions of a housing opposite the back faces of the end plates. When the movable scrolls abut against the portions of the housing through seal members at peripheral portions of the back faces of the end plates, partitions are formed between the inlet paths of the compressor formed at the side of the scroll bodies of the movable scrolls and the anti-rotation mechanisms, the bearings of the main shaft and the bearings at the operative engagement points. Therefore, powder of abraded materials of the anti-rotation mechanisms and bearings, grease, etc. are prevented from entering into the operation chambers and discharged gas from the compressor is prevented from contamination by powder of abraded materials of the anti-rotation mechanisms and bearings, grease, etc. As a result, the scroll compressor in accordance with the present invention can be used for compression of clean gas.

Partitions are formed between the inlet paths of the compressor formed at the side of the scroll bodies of the movable scrolls and the anti-rotation mechanisms, the bearings of the main shaft and the bearings at the operative engagement points. Therefore, gas heated by the anti-rotation mechanisms and bearings to be increased in specific volume is prevented from entering into the operation chambers. As a result, the flow rate of discharged gas from the compressor is prevented from substantial decrease.

According to another preferred embodiment of the present invention, difference in phase angles of 180 degrees is present between scroll bodies of the fixed scrolls.

When difference in phase angles of 180 degrees is present between the scroll bodies of the fixed scrolls, difference in phase angles of 180 degrees is generated between pulsations of discharged gases from the two pairs of fixed and movable scrolls. Therefore, the pulsations of discharged gases cancel each other and generation of noise due to the pulsation of discharged gas is prevented. Moreover, difference in phase angles of 180 degrees is generated between pulsations of intake gases into the two pairs of fixed and movable scrolls. Therefore, the pulsations of intake gases cancel each other and generation of noise due to the pulsation of intake gas is prevented.

According to another preferred embodiment of the present invention, the relation $r_0>r>(r_0-0.3\text{ mm})$ is present between a revolution radius r of the movable scrolls determined by the anti-rotation mechanisms and a revolution radius $r_0$ of the movable scrolls determined by the scroll bodies of the fixed scrolls and the scroll bodies of the movable scrolls.

When $r_0>r$, interferences between the scroll bodies of the fixed scrolls and the scroll bodies of the movable scrolls are prevented and generation of powder of abraded members due to such interferences is prevented. When $r>(r_0-0.3\text{ mm})$, decrease of compression efficiency is prevented.

According to another preferred embodiment of the present invention, the housing is provided with air holes opposite the back faces of the end plates of the movable scrolls.

When the housing is provided with air holes opposite the back faces of the end plates of the movable scrolls, spaces formed between the back faces of the end plates of the movable scrolls and the housing communicate with the atmosphere through the air holes. Therefore, heat generated by the anti-rotation mechanisms, bearings, etc. disposed in the spaces disperses to the atmosphere through the air holes. As a result, decrease of compression efficiency due to thermal deformation of movable scrolls is prevented and shortening of the service lives of the anti-rotation mechanisms, bearings, etc. due to loss of grease, thermal deformation, etc. is prevented.

According to another preferred embodiment of the present invention, the end plates of the movable scrolls are provided with cooling fins at their back faces.

When the end plates of the movable scrolls are provided with cooling fins at their back faces, cooling efficiency of the movable scrolls, anti-rotation mechanisms and bearings is enhanced.

According to another preferred embodiment of the present invention, the main shaft is provided with balancing weights and axial fans connected to the balancing weights at its portions extending between the back faces of the end plates of the movable scrolls and the portions of the housing opposite the back faces of the end plates.

According to another preferred embodiment of the present invention, the main shaft is provided with balancing weights and centrifugal fans connected to the balancing weights at its portions extending between the back faces of the end plates of the movable scrolls and the portions of the housing opposite the back faces of the end plates.

When balancing weights are provided with axial fans or centrifugal fans, cooling efficiency of the movable scrolls, anti-rotation mechanisms and bearings is enhanced.

According to another preferred embodiment of the present invention, the centrifugal fans are provided with deflectors for directing the discharged air parallel to the main shaft.

When the centrifugal fans are provided with deflectors for directing the discharged air parallel to the main shaft, the flow rate of air colliding against the end plates of the movable scrolls increases and cooling efficiency of the movable scrolls is enhanced.

According to another preferred embodiment of the present invention, a cooling chamber communicating with the space outside the housing is disposed between the end plates of the fixed scrolls.

End plates of the fixed scrolls are cooled by airflow induced in the cooling chamber. As a result, thermal deformation of fixed scrolls is restrained and decrease of compression efficiency due to such thermal deformation of fixed scrolls is suppressed.

According to another preferred embodiment of the present invention, the end plates of the fixed scrolls and movable scrolls are disks with their peripheral portions partially cut off arcuately.

The end plates of fixed scrolls and movable scrolls are usually disks. Portions of the disks radially outside the scroll bodies serve no function. Partial cutting off of the functionless portions of the disks enables downsizing of the compressor.

Further objects, features and advantages of the present invention will become apparent from the Detailed Description of the Preferred Embodiment when read in conjunction with the accompanying drawings.

BRIEF DESCRIPTION OF THE DRAWINGS

The present invention may be more readily understood with reference to the following drawings, in which.

DETAILED DESCRIPTION OF THE PREFERRED EMBODIMENT

Figure 1:
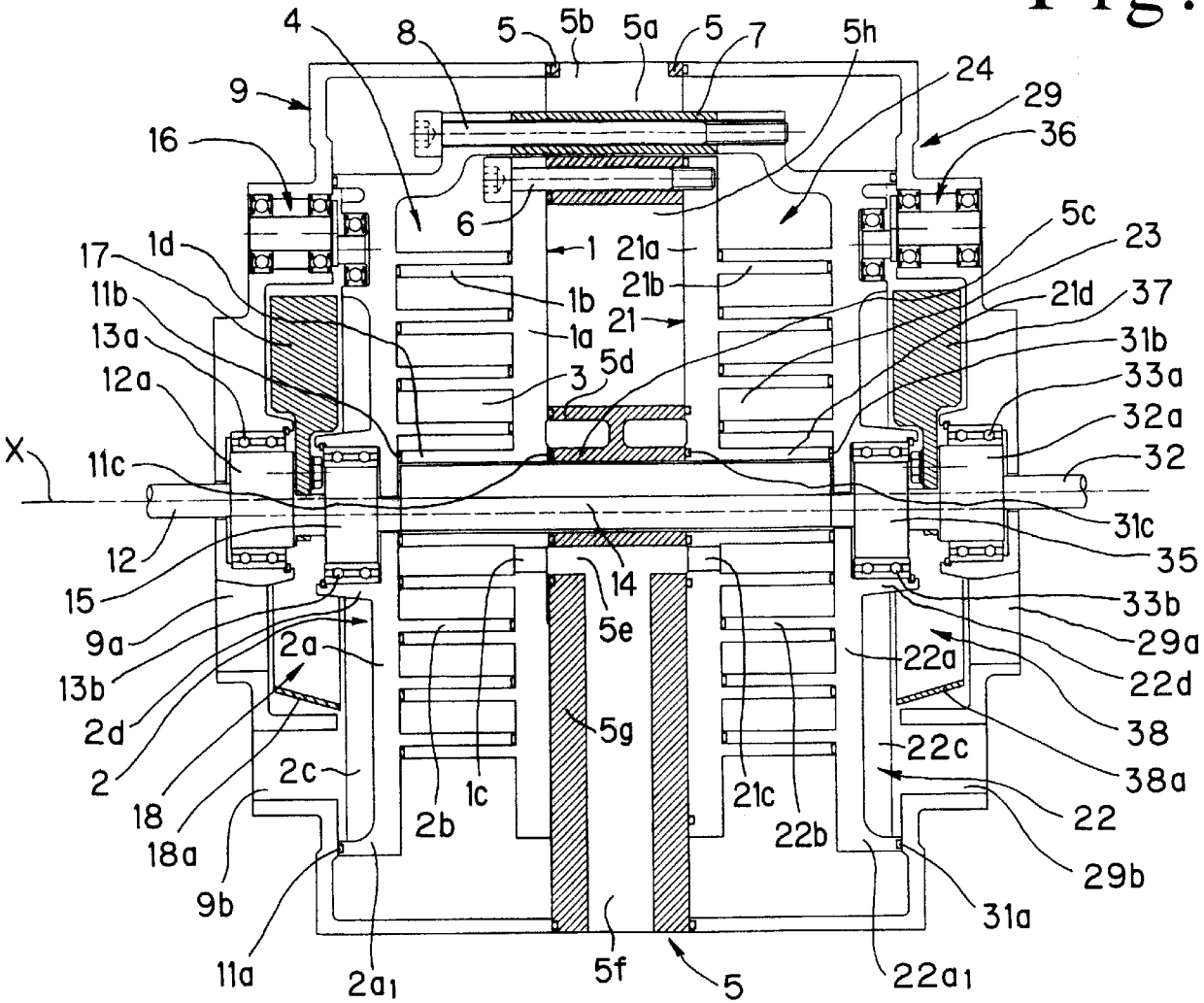
FIG. 1 is a side sectional view of a scroll compressor in accordance with a preferred embodiment of the present invention.

A scroll compressor in accordance with a preferred embodiment of the present invention will be described referring to FIGS. 1 to 3.

A scroll compressor in accordance with the present embodiment is provided with a scroll assembly 4 comprising a fixed scroll 1 having an end plate 1*a* and a scroll body 1*b* projecting from the end plate 1*a* and a movable scroll 2 having an end plate 2*a* and a scroll body 2*b* projecting from the end plate 2*a*. The movable scroll 2 meshes with the fixed scroll 1 to form a plurality of operation chambers 3 between them.

The scroll compressor is also provided with a scroll assembly 24 comprising a fixed scroll 21 having an end plate 21*a* and a scroll body 21*b* projecting from the end plate 21*a* and a movable scroll 22 having an end plate 22*a* and a scroll body 22*b* projecting from the end plate 22*a*. The movable scroll 22 meshes with the fixed scroll 21 to form a plurality of operation chambers 23 between them.

The back face of the end plate 1*a* of the fixed scroll 1 faces the back face of the end plate 21*a* of the fixed scroll 21. The end plate 1*a* of the fixed scroll 1 is provided with a discharge hole 1*c* at its center and the end plate 21*a* of the fixed scroll 21 is provided with a discharge hole 21*c* at its center.

The end plates 1*a*, 21*a* of the fixed scrolls 1, 21 and the end plates 2*a*, 22*a* of the movable scrolls 2, 22 are disks with their peripheral portions radially outside the scroll bodies 1*b*, 21*b*, 2*b* and 22*b* partially cut off arcuately.

A center block 5 is disposed between the end plate 1*a* of the fixed scroll 1 and the end plate 21*a* of the fixed scroll 21. The fixed scroll 1, the center block 5 and the fixed scroll 21 are integrally connected with each other by a plurality of bolts 6. Difference in phase angles of 180 degrees is present between the scroll body 1*b* of the fixed scroll 1 and the scroll body 21*b* of the fixed scroll 21.

The center block 5 is provided with a pair of arcuate holes 5*a*. The movable scroll 2 and the movable scroll 22 are integrally connected with each other by a plurality of connecting rods 7 movably passing through the arcuate holes 5*a* and a plurality of bolts 8 passing through the connecting rods 7. Difference in phase angles of 180 degrees is present between the scroll body 2*b* of the movable scroll 2 and the scroll body 1*b* of the fixed scroll 1. Difference in phase angles of 180 degrees is present between the scroll body 22*b* of the movable scroll 22 and the scroll body 21*b* of the fixed scroll 21.

A front housing 9 abuts against the center block 5. The front housing 9 cooperates with the center block 5 to form a housing for accommodating the scroll assembly 4.

A rear housing 29 also abuts against the center block 5. The rear housing 29 cooperates with the center block 5 to form a housing for accommodating the scroll assembly 24.

The front housing 9, the center block 5 and the rear housing 29 are integrally connected with each other by a plurality of bolts 10.

An annular seal member 11*a* is embedded in a peripheral portion $2a_1$ of the end plate 2*a* of the movable scroll 2. The seal member 11*a* projects from the peripheral portion $2a_1$ and abuts against the front housing 9 to be able to slide.

An annular seal member 31*a* is embedded in a peripheral portion $22a_1$ of the end plate 22*a* of the movable scroll 22. The seal member 31*a* projects from the peripheral portion $22a_1$ and abuts against the rear housing 29 to be able to slide.

The front housing 9 is provided with air holes 9*a* and 9*b* at its portion opposite the back face of the end plate 2*a* of the movable scroll 2. The rear housing 29 is provided with air holes 29*a* and 29*b* at its portion opposite the back face of the end plate 22*a* of the movable scroll 22.

The end plates 2*a* and 22*a* of the movable scrolls 2 and 22 are provided with a plurality of radially extending cooling fins 2*c* and 22*c* at their back faces.

A shaft 12 passes into and extends through the front housing 9. The shaft 12 has a large diameter portion 12*a* extending in the front housing 9. The large diameter portion 12*a* is supported to be rotatable by the front housing 9 through a bearing 13*a*.

A shaft 32 passes into and extends through the rear housing 29. The shaft 32 has a large diameter portion 32*a* extending in the rear housing 29. The large diameter portion 32*a* is supported to be rotatable by the rear housing 29 through a bearing 33*a*.

The large diameter portion 12*a* is integrally connected to the large diameter portion 32*a* by an offset shaft 14. The offset shaft 14 passes through the fixed scrolls 1 and 21 and the movable scrolls 2 and 22. The shaft 12, the offset shaft 14 and the shaft 32 cooperate to form a main shaft.

A bush 15 fits on the offset shaft 14 to be able to slide around the offset shaft 14. The bush 15 is accommodated in a boss 2*d* formed in the back face of the end plate 2*a* of the movable scroll 2 through a bearing 13*b*. The offset shaft 14 operatively engages the movable scroll 2 through the bush 15, the bearing 13*b* and the boss 2*d*.

A bush 35 fits on the offset shaft 14 to be able to slide around the offset shaft 14. The bush 35 is accommodated in a boss 22*d* formed in the back face of the end plate 22*a* of the movable scroll 22 through a bearing 33*b*. The offset shaft 14 operatively engages the movable scroll 22 through the bush 35, the bearing 33*b* and the boss 22*d*.

An anti-rotation mechanism 16 is disposed between the movable scroll 2 and the front housing 9 opposite the movable scroll 2. The anti-rotation mechanism 16 comprises a plurality of bearings and an auxiliary crank.

An anti-rotation mechanism 36 is disposed between the movable scroll 22 and the rear housing 29 opposite the movable scroll 22. The anti-rotation mechanism 36 comprises a plurality of bearings and an auxiliary crank.

The anti-rotation mechanism 16 is offset circumferentially by about 90 degrees from the anti-rotation mechanism 36

The relation $r_0>r>(r_0-0.3$ mm) is present between a revolution radius r of the movable scrolls 2 and 22 determined by the anti-rotation mechanisms 16 and 36 and a revolution radius $r_0$ of the movable scrolls 2 and 22 determined by the scroll bodies 1*b* and 21*b* of the fixed scrolls 1 and 21 and the scroll bodies 2*b* and 22*b* of the movable scrolls 2 and 22.

A balancing weight 17 is fixed to the large diameter portion 12*a* of the shaft 12. The balancing weight 17 is provided with a centrifugal fan 18. The centrifugal fan 18 is provided with a deflector 18*a* for directing discharged air parallel to the main shaft and to the end plate 2*a* of the movable scroll 2.

A balancing weight 37 is fixed to the large diameter portion 32*a* of the shaft 32. The balancing weight 37 is provided with a centrifugal fan 38. The centrifugal fan 38 is provided with a deflector 38*a* for directing discharged air parallel to the main shaft and to the end plate 22*a* of the movable scroll 22.

The end plate 1*a* of the fixed scroll 1 is provided with a boss 1*d* surrounding the offset shaft 14. An annular seal member 11*b* is embedded in the end face of the boss 1*d*. The seal member 11*b* projects from the end face of the boss 1*d* and abuts against the end plate 2*a* of the movable scroll 2 to be able to slide.

The end plate 21*a* of the fixed scroll 21 is provided with a boss 21*d* surrounding the offset shaft 14. An annular seal member 31*b* is embedded in the end face of the boss 21*d*. The seal member 31*b* projects from the end face of the boss 21*d* and abuts against the end plate 22*a* of the movable scroll 22 to be able to slide.

The center block 5 is provided with an inlet port 5*b* communicating with the arcuate hole 5*a*. The center block 5 is provided with a boss 5*c* surrounding the offset shaft 14. The center block 5 is provided with a cylindrical portion 5*d* radially outside the boss 5*c*. The cylindrical portion 5*d* is made integral with the boss 5*c* and extends coaxially with the boss 5*c*. The center block 5 is provided with an outlet chamber 5*e* between the boss 5*c* and the cylindrical portion 5*d*. The outlet chamber 5*e* communicates with the discharge hole 1*c* of the fixed scroll 1 and the discharge hole 21*c* of the fixed scroll 21. The center block 5 is provided with an outlet port 5*f*. The outlet chamber 5*e* communicates with the outlet port 5*f* through a cylindrical portion 5*g*. The center block 5 is provided with a cooling chamber 5*h* radially outside the cylindrical portion 5*d* and between the end plate 1*a* of the fixed scroll 1 and the end plate 21*a* of the fixed scroll 21. The cooling chamber 5*h* communicates with the space outside the center block 5 through an air hole 5*i*.

The abutting point between the boss 5*c* and the end plate 1*a* of the fixed scroll 1 is sealed by the seal member 11*c* and the abutting point between the boss 5*c* and the end plate 21*a* of the fixed scroll 21 is sealed by the seal member 31*c*.

Figure 2:
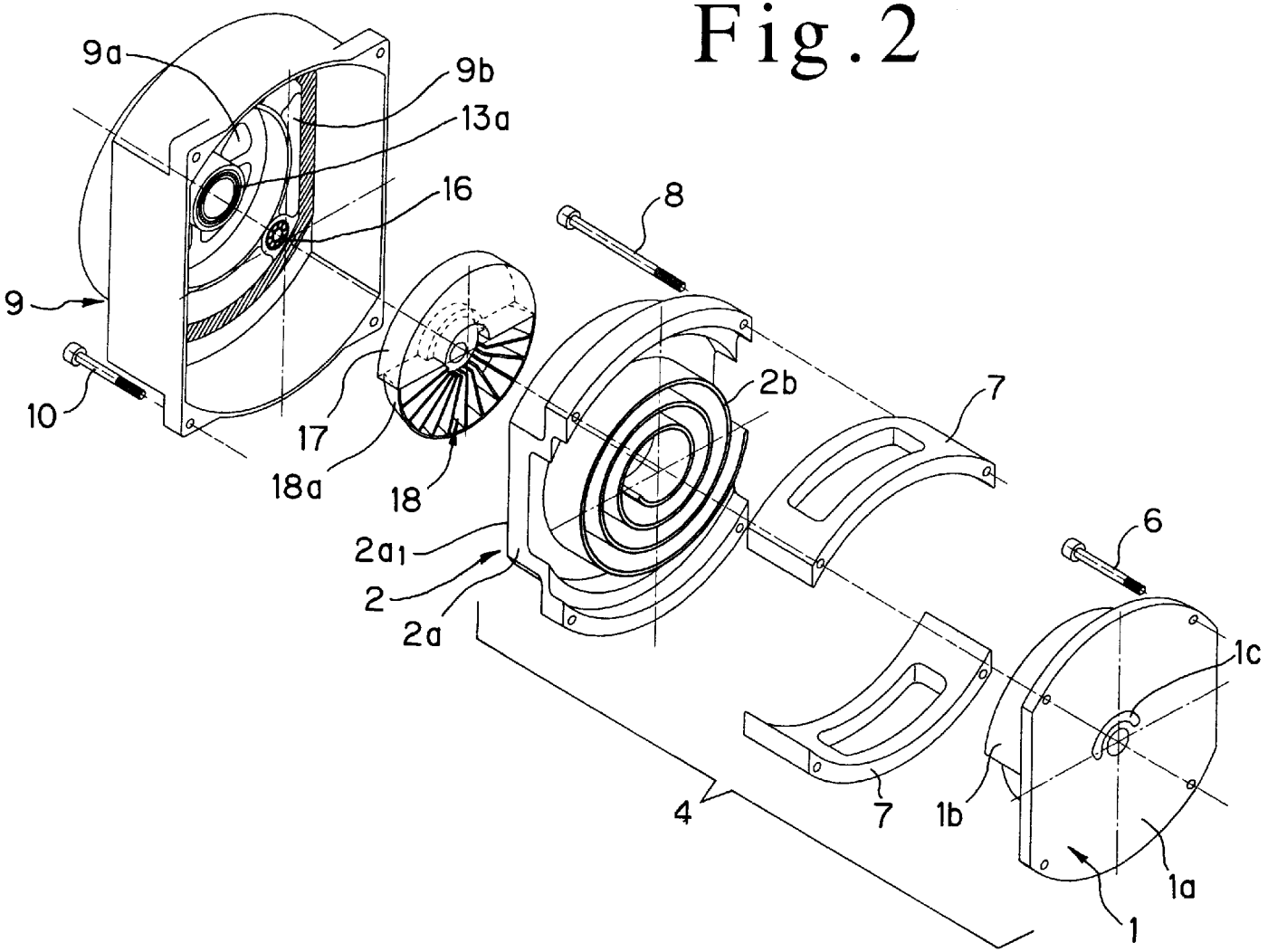
FIG. 2 is a perspective view of a half of a scroll compressor in accordance with a preferred embodiment of the present invention.
Figure 3:
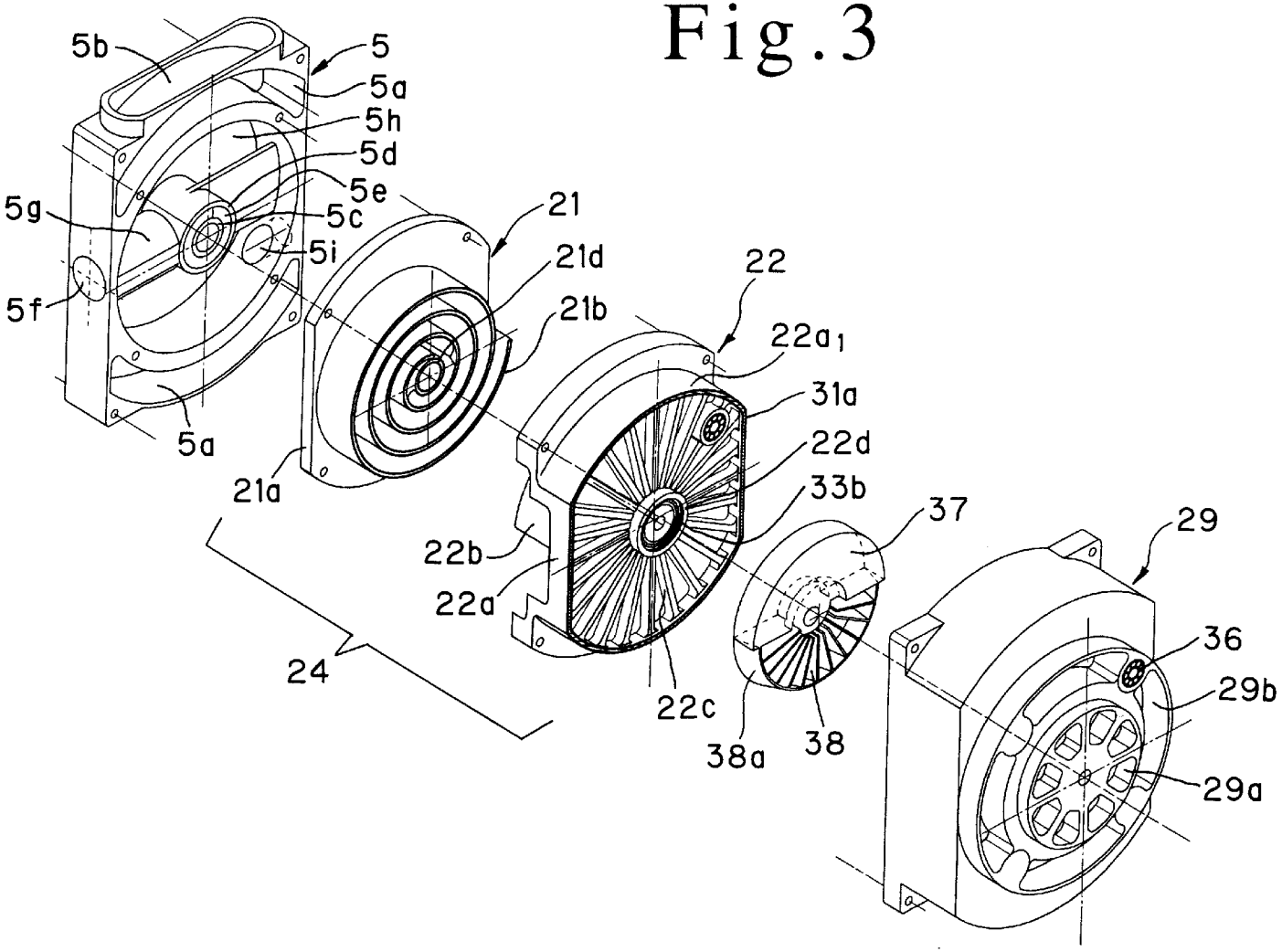
FIG. 3 is a perspective view of a half of a scroll compressor in accordance with a preferred embodiment of the present invention.

In operation, the shaft 12 is rotated around the central axis X by a driving means not shown in FIGS. 1 to 3. The offset shaft 14 rotates around the axis X accompanying the shaft 12. Rotation of the offset shaft 14 is transmitted to the movable scrolls 2 and 22 operatively engaging the offset shaft 14 through the bushes 15 and 35. Thus, the movable scrolls 2 and 22 integrally connected with each other revolve around the axis X. Gas is taken into the compressor through the inlet port 5*b* and then into the operation chambers 3 and 23. The operation chambers 3 and 23 approach the center of the fixed scrolls 1 and 21 with their volume gradually decreasing. Thus, the gas in the operation chambers 3 and 23 is compressed. The compressed gas discharges into the outlet chamber 5*e* through the discharge holes 1*c* and 21*c* of the end plates 1*a* and 21*a* of the fixed scrolls 1 and 21 and discharges from the compressor through the outlet port 5*f*.

The movable scrolls 2 and 22 are allowed to revolve but are prevented from rotation by the anti-rotation mechanisms 16 and 36.

In the scroll compressor of the present embodiment, the movable scrolls 2 and 22 integrally connected with each other bear the thrust load accompanying the compression of gas in the operation chambers 3 and 23. Therefore, the anti-rotation mechanism 16 disposed between the end plate 2*a* of the movable scroll 2 and the front housing 9 opposite the end plate 2*a* does not bear the thrust load. Similarly, the anti-rotation mechanism 36 disposed between the end plate 22*a* of the movable scroll 22 and the rear housing 29 opposite the end plate 22*a* does not bear the thrust load. As a result, wear of the anti-rotation mechanisms 16 and 36 is minimized and decrease of service life of the compressor is minimized. Being free from the thrust load, the anti-rotation mechanisms 16 and 36 can be downsized. As a result, the compressor can be downsized.

In the scroll compressor of the present embodiment, the fixed scrolls 1 and 21 are integrally connected with each other and the movable scrolls 2 and 22 are integrally connected with each other. Therefore, axial space between the fixed scroll 1 and the movable scroll 2 and the axial space between the fixed scroll 21 and the movable scroll 22 can be adjusted by a single operation of adjusting the length of the connecting rods 7 integrally connecting the movable scrolls 2 and 22 or of adjusting the thickness of shims inserted between end faces of the connecting rods 7 and the movable scrolls 2 and 22.

In the scroll compressor of the present embodiment, the bushes 15 and 35, the bearings 13*b* and 33*b* and the bosses 2*d* and 22*d* constituting the operative engagement points between the offset shaft 14 and the movable scrolls 2 and 22 are disposed at the back faces of the end plates 2*a* and 22*a* of the movable scrolls 2 and 22. Thus, these members are close to the front housing 9 and the rear housing 29. Therefore, heat generated by the bearings 13*b* and 33*b* at the operative engagement points easily disperses to the outside the compressor through the front housing 9 and the rear housing 29. As a result, heating of the bearings 13*b* and 33*b* is minimized and decrease of the service lives of the bearings 13*b* and 33*b* is minimized.

In the scroll compressor of the preset embodiment, the end plates 2*a* and 22*a* abut against the front housing 9 and the rear housing 29 at peripheral portions $2a_1$ and $22a_1$ of their back faces through the seal members 11*a* and 31*a*. Thus, partitions are formed between the inlet paths of the compressor formed at the side of the scroll bodies 2*b* and 22*b* of the movable scrolls 2 and 22 and the anti-rotation mechanisms 16 and 36, and the bearings 13*a*, 33*a*, 13*b* and 33*b*. Therefore, powder of abraded materials of the anti-rotation mechanisms 16 and 36, and the bearings 13*a*, 33*a*, 13*b* and 33*b*, grease, etc. are prevented from entering into the operation chambers 3 and 23 and discharged gas from the compressor is prevented from contamination by the powder of abraded materials, grease, etc. As a result, the scroll compressor of the present embodiment can be used for compression of clean gas.

Partitions are formed between the inlet paths of the compressor formed at the side of the scroll bodies 2*b* and 22*b* of the movable scrolls 2 and 22 and the anti-rotation mechanisms 16 and 36, and the bearings 13*a*, 33*a*, 13*b* and 33*b*. Therefore, gas heated by the anti-rotation mechanisms 16 and 36, and the bearings 13*a*, 33*a*, 13*b* and 33*b*, to be increased in specific volume is prevented from entering into the operation chambers 3 and 23. As a result, flow rate of discharged gas from the compressor is prevented from substantial decrease.

In the scroll compressor of the present embodiment, the bosses 1*d* and 21*d* of the fixed scrolls 1 and 21 abut against the end plates 2*a* and 22*a* of the movable scrolls 2 and 22 through the seal members 11*b* and 31*b*. Therefore, grease in the bearings 13*a*, 33*a*, 13*b* and 33*b* does not enter into the operation chambers 3 and 23 along the offset shaft 14 and contaminate the discharged gas from the compressor.

The abutting points between the boss 5*c* of the center block 5 and the end plates 1*a* and 21*a* of the fixed scrolls 1 and 21 are sealed by the seal members 11*c* and 31*c*. Therefore, grease in the bearings 13*a*, 33*a*, 13*b* and 33*b* does not enter into the outlet chamber 5*e* along the offset shaft 14 and contaminate the discharged gas from the compressor.

In the scroll compressor of the present embodiment, difference in phase angles of 180 degrees is present between the scroll bodies 1*b* and 21*b* of the fixed scrolls 1 and 21. Thus, difference in phase angles of 180 degrees is generated between pulsation of discharged gas from the paired fixed scroll 1 and movable scroll 2 and pulsation of discharged gas from the paired fixed scroll 21 and movable scroll 22. Therefore, the pulsations of the two discharged gases cancel each other and noise due to the pulsation of discharged gas is prevented from generation. Moreover, difference in phase angles of 180 degrees is generated between pulsation of intake gas into the paired fixed scroll 1 and movable scroll 2 and pulsation of intake gas into the paired fixed scroll 21 and movable scroll 22. Therefore, the pulsations of the two intake gases cancel each other and noise due to the pulsation of intake gas is prevented from generation.

In the scroll compressor of the present embodiment, the relation $r_0>r$ is present between a revolution radius r of the movable scrolls 2 and 22 determined by the anti-rotation mechanisms 16 and 36 and a revolution radius $r_0$ of the movable scrolls 2 and 22 determined by the scroll bodies 1*b* and 21*b* of the fixed scrolls 1 and 21 and the scroll bodies 2*b* and 22*b* of the movable scrolls 2 and 22. As a result, interferences between the scroll bodies 1*b* and 21*b* of the fixed scrolls 1 and 21 and the scroll bodies 2*b* and 22*b* of the movable scrolls 2 and 22 are prevented and generation of powder of abraded members due to such interferences is prevented. Moreover, the relation $r>(r_0-0.3\text{ mm})$ is present between the revolution radiuses r and $r_0$. As a result, decrease of compression efficiency is prevented.

In the scroll compressor of the present embodiment, spaces formed between the back faces of the end plates 2*a* and 22*a* of the movable scrolls 2 and 22 and the front and housing 9 and the rear housing 29 communicate with the atmosphere through the air holes 9*a*, 9*b*, 29*a* and 29*b*. Therefore, heat generated by the anti-rotation mechanisms 16 and 36, and the bearings 13*a*, 13*b*, 33*a* and 33*b* disperses to the atmosphere through the air holes 9*a*, 9*b*, 29*a* and 29*b*. As a result, decrease of compression efficiency due to thermal deformation of the movable scrolls 2 and 22 is prevented and shortening of service lives of the anti-rotation mechanisms 16 and 36, and the bearings 13*a*, 13*b*, 33*a* and 33*b* due to loss of grease or thermal deformation is prevented.

In the scroll compressor of the present embodiment, the end plates 2*a* and 22*a* of the movable scrolls 2 and 22 are provided with cooling fins 2*c* and 22*c* at their back faces. As a result, cooling efficiencies of the movable scrolls 2 and 22, the anti-rotation mechanisms 16 and 36, and the bearings 13*a*, 13*b*, 33*a* and 33*b* are enhanced.

In the scroll compressor of the present embodiment, the balancing weights 17 and 37 are provided with centrifugal fans 18 and 38. Therefore, external air is taken into the front housing 9 and the rear housing 29 through the air holes 9*a*, 9*b*, 29*a* and 29*b*. As a result, cooling efficiencies of the movable scrolls 2 and 22, the anti-rotation mechanisms 16 and 36, and the bearings 13*a*, 13*b*, 33*a* and 33*b* are enhanced.

In the scroll compressor of the present embodiment, discharged airs from the centrifugal fans 18 and 38 are directed to the end plates 2*a* and 22*a* of the movable scrolls 2 and 22 by the deflectors 18*a* and 38*a*. As a result, flow rates of the airs colliding against the end plates 2*a* and 22*a* of the movable scrolls 2 and 22 increase and cooling efficiencies of the movable scrolls 2 and 22 are enhanced.

The balancing weights 17 and 37 may be provided with axial fans instead of the centrifugal fans 18 and 38.

In the scroll compressor of the present embodiment, the cooling chamber 5*h* communicating with space outside the housing of the compressor is disposed between the end plates 1*a* and 21*a* of the fixed scrolls 1 and 21. Therefore, the end plates 1*a* and 21*a* of the fixed scrolls 1 and 21 are cooled by the airflow taken into the cooling chamber 5*h*. As a result, thermal deformations of the fixed scrolls 1 and 21 are restrained and decrease of compression efficiency due to such thermal deformations of the fixed scrolls 1 and 21 is suppressed.

In the scroll compressor of the present embodiment, functionless portions of the disk-shaped end plates 1*a* and 21*a* of the fixed scrolls 1 and 21 radially outside the scroll bodies 1*b* and 21*b* are partially cut off arcuately. In the scroll compressor of the present embodiment, functionless portions of the disk-shaped end plates 2*a* and 22*a* of the movable scrolls 2 and 22 radially outside the scroll bodies 2*b* and 22*b* are partially cut off arcuately. As a result, the scroll compressor of the present embodiment is downsized.

In the above embodiment, the difference in phase angles between the scroll bodies 1*b* and 21*b* of the fixed scrolls 1 and 21 need not be strictly 180 degrees. It may be larger or smaller than 180 degrees to some extent.

In the above embodiment, the difference in phase angles between the scroll bodies 2*b*, 22*b* of the movable scrolls 2, 22 and the scroll bodies 1*b*, 21*b* of the fixed scrolls 1, 21 need not be strictly 180 degrees. It may be larger or smaller than 180 degrees to some extent.

In the above embodiment, the numeral in the relation between r and $r_0$ need not be strictly 0.3. It may slightly deviate from 0.3.

While the present invention has been described with reference to preferred embodiments, one of ordinary skill in the art will recognize that modifications and improvements may be made while remaining within the spirit and scope of the present invention. The scope of the invention is determined solely by the appended claims.

I claim:

1. A scroll compressor comprising paired fixed and movable scrolls, the fixed scroll of each pair having an end plate provided with a scroll body projecting from the end plate and the movable scroll of each pair having an end plate provided with a scroll body projecting from the end plate, wherein the movable scroll meshes with the fixed scroll to form a plurality of operation chambers between them and revolves relative to the fixed scroll to compress gas in the operation chambers, characterized in that two pairs of fixed and movable scrolls are disposed with back faces of the end plates of the fixed scrolls opposite each other, the movable scrolls are integrally connected with each other, a main shaft for revolving the movable scrolls passes through the two pairs of fixed and movable scrolls to operatively engage the movable scrolls, and an outlet chamber is disposed between the end plates of the fixed scrolls.

2. A scroll compressor of claim 1, wherein difference in phase angles of 180 degrees is present between the scroll bodies of the fixed scrolls.

3. A scroll compressor of claim 1, wherein the relation $r_0>r>(r_0-0.3\text{ mm})$ is present between a revolution radius r of the movable scrolls determined by anti-rotation mechanisms for the movable scrolls and a revolution radius $r_0$ of the movable scrolls determined by the scroll bodies of the fixed scrolls and the scroll bodies of the movable scrolls.

4. A scroll compressor of claim 1, wherein the end plates of the fixed scrolls and the movable scrolls are disks with their peripheral portions partially cut off arcuately.

5. A scroll compressor of claim 1, wherein the main shaft operatively engages the movable scrolls at back faces of the end plates of the movable scrolls.

6. A scroll compressor of claim 5, wherein the movable scrolls abut against a housing accommodating the two pairs of fixed and movable scrolls through seal members at peripheral portions of the back faces of the end plates.

7. A scroll compressor of claim 6, wherein a cooling chamber communicating with space outside the housing is disposed between the end plates of the fixed scrolls.

8. A scroll compressor of claim 1, wherein the housing is provided with air holes opposite the back faces of the end plates of the movable scrolls.

9. A scroll compressor of claim 8, wherein the main shaft is provided with balancing weights and axial fans connected to the balancing weights at its portions extending between the back faces of the end plates of the movable scrolls and the housing.

10. A scroll compressor of claim 8, wherein the main shaft is provided with balancing weights and centrifugal fans connected to the balancing weights at its portions extending between the back faces of the end plates of the movable scrolls and the housing.

11. A scroll compressor of claim 10, wherein the centrifugal fans are provided with deflectors for directing discharged air parallel with the main shaft.

12. A scroll compressor of claim 1, wherein the end plates of the movable scrolls are provided with cooling fins at their back faces.

13. A scroll compressor of claim 12, wherein the main shaft is provided with balancing weights and axial fans connected to the balancing weights at its portions extending between the back faces of the end plates of the movable scrolls and the housing.

14. A scroll compressor of claim 12, wherein the main shaft is provided with balancing weights and centrifugal fans connected to the balancing weights at its portions extending between the back faces of the end plates of the movable scrolls and the housing.

15. A scroll compressor of claim 14, wherein the centrifugal fans are provided with deflectors for directing discharged air parallel with the main shaft.

* * * * *